US006245720B1

(12) United States Patent
Bacarella

(10) Patent No.: US 6,245,720 B1
(45) Date of Patent: Jun. 12, 2001

(54) HIGH-TEMPERATURE SYNTHETIC LUBRICIOUS COMPOSITION

(76) Inventor: Robert Bacarella, 150 Davis St., Hauppauge, NY (US) 11788

( * ) Notice: Subject to any disclaimer, the term of this patent is extended or adjusted under 35 U.S.C. 154(b) by 0 days.

(21) Appl. No.: 09/565,961

(22) Filed: May 5, 2000

Related U.S. Application Data

(60) Provisional application No. 60/132,827, filed on May 6, 1999.

(51) Int. Cl.[7] ..... C10M 125/26; C10M 169/04
(52) U.S. Cl. ..... 508/138
(58) Field of Search ..... 508/138

(56) References Cited

U.S. PATENT DOCUMENTS 4,396,514 * 8/1983 Randisi ..... 508/138
5,037,566 * 8/1991 Randisi ..... 508/138
6,127,320 * 10/2000 Van Ooij et al. ..... 508/138

* cited by examiner

*Primary Examiner*—Jacqueline V. Howard
(74) *Attorney, Agent, or Firm*—Timothy J. Shea II

(57) ABSTRACT

Synthetic lubricant compositions having several unique performance advantages over known lubricants are provided. The presently claimed compositions are either clear or translucent to white and non-staining. In addition, they have absolutely no odor, are non-toxic, and all ingredients are USDA approved. Finally, they retain their high-performance characteristics through a temperature range of about −40° F. up to about 550° F.

4 Claims, 1 Drawing Sheet

*synthetic multi-purpose, heavy duty grease specifications*

| | | |
|---|---|---|
| Composition | | Synthetic / Polymer |
| Visual Appearance | | Optically Clear |
| Shelf Life | | > 10 years |
| Oil Separation Test | ASTM D1742 60°C 24 Hours | Zero |
| | 120°C 24 Hours | Zero |
| Viscosity | Brookfield at 25°C | 1800 mcps +/- 100mcps |
| Cone Penetration | ASTM D217 (unworked) | |
| | at +25°C | 240 +/- 20 |
| | at -20°C | 160 +/- 20 |
| Drop Test | ASTM D566 at 250°C | Zero |
| Flash Point | ASTM D92 | 180°C |
| Continuous Use Temp. | Grease remains flexible & stable | -41°C to 204°C |
| Effect on Copper | ASTM D1261 | Zero |
| Effect on plastic, steel iron, bronze, acrylate | Electron Microscopy Detection of deterioration | No evidence is observed |
| Volatility | 150°C for 24 hours | < 1% |
| Evaporation Test | ASTM D972 85°C for 24 hrs. | < .3% |
| Oxidation Induction Time | Bellcore TR- TSY000421 | > 20 Minutes |
| Water Content | Karl Fisher Method | < .001% |
| Hydrogen Generation | ASTM D1018 | < 30 ppm |
| Four Ball Wear Test | ASTM D2266 Scar diameter | 0.48 mm |
| Salt Spray Test | ASTM B117 | Pass |
| Four Ball E.P. Test | ASTM D2596 | |
| | Load Wear Index | 43.25 kg. |
| | Weld Point | 208 kg. |
| Water Washout | ASTM D1264 | |
| | 37.8°C (100°F) | < 1% |
| | 79.4°C (175°F) | < 1% |
| Rust Preventative Test | ASTM D1743 | Pass |

*synthetic multi-purpose, heavy duty grease specifications*

| | | |
|---|---|---|
| Composition | | Synthetic / Polymer |
| Visual Appearance | | Optically Clear |
| Shelf Life | | > 10 years |
| Oil Separation Test | ASTM D1742 60°C 24 Hours | Zero |
| | 120°C 24 Hours | Zero |
| Viscosity | Brookfield at 25°C | 1800 mcps +/- 100mcps |
| Cone Penetration | ASTM D217 (unworked) | |
| | at +25°C | 240 +/- 20 |
| | at -20°C | 160 +/- 20 |
| Drop Test | ASTM D566 at 250°C | Zero |
| Flash Point | ASTM D92 | 180°C |
| Continuous Use Temp. | Grease remains flexible & stable | -41°C to 204°C |
| Effect on Copper | ASTM D1261 | Zero |
| Effect on plastic, steel iron, bronze, acrylate | Electron Microscopy Detection of deterioration | No evidence is observed |
| Volatility | 150°C for 24 hours | < 1% |
| Evaporation Test | ASTM D972 85°C for 24 hrs. | < .3% |
| Oxidation Induction Time | Bellcore TR- TSY000421 | > 20 Minutes |
| Water Content | Karl Fisher Method | < .001% |
| Hydrogen Generation | ASTM D1018 | < 30 ppm |
| Four Ball Wear Test | ASTM D2266 Scar diameter | 0.48 mm |
| Salt Spray Test | ASTM B117 | Pass |
| Four Ball E.P. Test | ASTM D2596 | |
| | Load Wear Index | 43.25 kg. |
| | Weld Point | 208 kg. |
| Water Washout | ASTM D1264 | |
| | 37.8°C (100°F) | < 1% |
| | 79.4°C (175°F) | < 1% |
| Rust Preventative Test | ASTM D1743 | Pass |

FIG. 1

HIGH-TEMPERATURE SYNTHETIC LUBRICIOUS COMPOSITION

This application claims the benefit of Provisional Application No. 60/132,827 filed May 6, 1999.

FIELD OF THE INVENTION

This invention relates to high-temperature synthetic lubricious compositions that are suitable for use in operations including the processing and preparation of foodstuffs.

BACKGROUND OF THE INVENTION

A wide variety of industrial and mechanical apparati require lubrication of their moving parts to prevent premature wear and failure of the equipment. Natural lubricants, such as animal and vegetable fats, oils, and greases have been known for millennia. However, as the industrial age arrived, these were found not to be suitable in the high temperature, high pressure conditions experienced in the machinery being developed. Petroleum-based lubricants have been known for over a century and have been developed for many such applications. However, the cost of locating, extracting, and refining crude oil to manufacture these lubricants, as well as limitations on their performance and durability, led to the development in this century of synthetic lubricants.

Synthetic lubricants have been developed to meet a variety of needs and have in the last twenty years gained in both their technical performance and their popularity. However, most synthetic lubricants include ingredients that are not suitable for certain applications, e.g., for use in food processing and preparation. It is highly desirable to have a cost-effective, high-performance lubricant that is approved for such uses by the United States Department of Agriculture.

In addition, process conditions play a significant role in determining both the performance and commercial acceptance of a synthetic lubricant. If the heating conditions during preparation of the lubricant are not optimal, e.g., if the lubricant is heated too much or too little or at the wrong point in the process, the lubricant can have an undesirable color or smell. One popular ingredient, Irgalube, can impart a sweet smell that is not always desirable. However, omitting this ingredient to eliminate the odor can alter the performance characteristics of the lubricant. In addition, replacement with DuPont's Teflon® may result in a lubricant that has an uneven consistency. Replacement with Krylon® (liquid Teflon® in an isopropyl base) may resolve the consistency problems, but the isopropyl doesn't react well at high temperatures.

SUMMARY OF THE INVENTION

The present invention relates to synthetic lubricant compositions and methods for their manufacture and use. The compositions comprise mixtures of hydrogenated poly-α-olefins, styrene-ethylene/propylene copolymer, petroleum hydrocarbons, fumed silica, propylene glycol, and PTFE.

A critical element to the successful preparation of compositions in accordance with the present invention is the use of fine-grained PTFE that is easily mixed into the composition. Use of such PTFE not only solves the problem of an undesirable smell but also results in a nice appearance to the product. In addition, the resultant compositions perform at a much higher level than known compositions.

The presently claimed synthetic lubricant compositions provide several unique performance advantages over known lubricants. The presently claimed compositions are either clear or translucent to white and non-staining. In addition, they have absolutely no odor, are non-toxic, and all ingredients are USDA approved. Finally, they retain their high-performance characteristics through a temperature range of about −40° F. up to about 550° F.

DRAWINGS

FIG. 1 shows the technical specifications for synthetic lubricious compositions of the present invention.

DETAILED DESCRIPTION

The present invention may be embodied in a variety of formulations. One feature of the invention, putting high heat on the poly-α-olefin oil, enables the consistent production of a high-quality composition; even if you overheat the batch, you still won't burn the oil.

The ranges of each component of the composition are as follows:

| Ingredient | CAS Number | wt % |
|---|---|---|
| 1.) Hydrogenated Poly-α-olefins | 68037-01-4 | 33–81 |
| 2.) Styrene-Ethylene/Propylene Copolymer | 68648-89-5 | 2–4 |
| 3.) Petroleum Hydrocarbons | 8042-47-5 | 1–60 |
| 4.) Fumed Silica | 112945-52-5 | 5–10 |
| 5.) Propylene Glycol | 029434-03-5 | 2–5 |
| 6.) PTFE | 79070-11-4 | 1–5 |

Optionally, 2–5 wt % polybutane (CAS No. 9003-29-6) may be added. Regardless of the amounts of individual ingredients used, the liquid portion of the composition equals about 90%.

Example 1

A 10% by weight Shelvis solution was prepared using a 55 gallon drum with a high-temperature heat belt. 375 lbs of Amoco Dynacyn 168 (poly-α-olefin) was pre-heated to 200–240° F. 40 lbs Shelvis-50 (styrene-ethylene/propylene copolymer) powder was added to the pre-heated poly-α-olefin and the mixture was mixed under low agitation for approximately 3 hours with a 20 hp Schold mixer until the powder was melted. The liquid was strained through a 100$\mu$ mesh strainer (filter bag).

Example 2

PTFE paste was prepared by adding 40 lbs of PTFE powder to 20 lbs Amoco Dynacyn 168 (poly-α-olefin) and grinding the mixture together at 140° F. until it formed a paste.

Example 3

A synthetic high-temperature grease was prepared as follows. 110 lbs of the 10% Shelvis solution was mixed with 50 lbs Dynasyn 168 (poly-α-olefin), and 105 lbs mineral oil and the mixture was preheated to 125° F. 11 lbs Indepol 300 (polybutane), 8 lbs PTFE paste, 18 lbs fumed silica M-5, and 10 lbs propylene glycol 2025 were slowly sequentially added as the mixture was mixed. This yielded 312 lbs of the composition.

Example 4

| Ingredient | CAS Number | wt % |
|---|---|---|
| 1.) Hydrogenated poly-α-olefins | 68037-01-4 | 48 |
| 2.) Styrene-Ethylene/Propylene Copolymer | 68648-89-5 | 3.5 |
| 3.) Petroleum Hydrocarbons | 8042-47-5 | 33 |
| 4.) Polybutane | 9003-29-6 | 3.5 |
| 5.) Fumed Silica | 112945-52-5 | 7 |
| 6.) Propylene Glycol | 029434-03-5 | 3 |
| 7.) PTFE | 79070-11-4 | 2 |

A high-temperature, synthetic lubricant composition was prepared as follows. Hydrogenated poly-α-olefins were heated to about 240° F. Styrene-ethylene/propylene copolymer was added and mixed at low agitation until dissolved (melted) and the solution was strained through a 100 micron mesh filter bag. Petroleum hydrocarbons and polybutane were slowly added and mixed for 15 minutes. PTFE was added and the composition mixed for 10 minutes and the temperature was reduced to 125° F. gradually in order to maintain the composition's viscosity. At this point, it is important to verify that the temperature of the composition is 125° F. Fumed silica was then slowly added, making sure not to create too much dust. Finally, polypropylene glycol was added and the composition was mixed thoroughly and run through a Cornell Versator.

While the present invention has been described in terms of specific methods and compositions, it is understood that variations and modifications will occur to those skilled in the art upon consideration of the present invention. Numerous modifications and variations in the invention as described in the above illustrative examples are expected to occur to those skilled in the art.

What is claimed is:

1. A high-temperature, synthetic lubricant composition comprising 33–81 wt % hydrogenated poly-α-olefins, 2–4 wt % styrene-ethylene/propylene copolymer, 1–60 wt % petroleum hydrocarbons, 5–10 wt % fumed silica, 2–5 wt % propylene glycol, and 1–5 wt % PTFE.

2. The high-temperature, synthetic lubricant composition as claimed in claim 1 further comprising 2–5 wt % polybutane.

3. A method for manufacturing a high-temperature, synthetic lubricant composition, the method comprising the following steps:

(a) heating 33–81 wt % hydrogenated poly-α-olefin to about 240° F.;

(b) adding 2–4 wt % styrene-ethylene/propylene copolymer to said heated hydrogenated poly-α-olefin;

(c) mixing the above ingredients under low agitation until the styrene-ethylene/propylene copolymer is dissolved;

(d) straining the resultant solution through a 100 micron mesh filter bag;

(e) slowly adding 1–60 wt % petroleum hydrocarbons and mixing the composition for an additional 15 minutes under low agitation;

(f) adding 1–5 wt % PTFE and mixing the composition for an additional 10 minutes under low agitation;

(g) verifying that the temperature of the composition is 125° F.

(h) slowly adding 5–10 wt % fumed silica to the above mixture;

(i) Adding 2–5 wt % polypropylene glycol to the above mixture while mixing the composition under low agitation;

(j) filtration of the thoroughly mixed composition through a Cornell Versator.

4. The method as claimed in claim 3 further comprising addition of 2–5 wt % polybutane in step (e).

* * * * *